United States Patent [19]

Frankel

[11] Patent Number: 4,638,512

[45] Date of Patent: Jan. 27, 1987

[54] SWEAT COLLECTING HEADBAND

[76] Inventor: Alfred R. Frankel, 403 Gulf Way - Apt. 701, St. Petersburg, Fla. 33706

[21] Appl. No.: 721,887

[22] Filed: Apr. 11, 1985

[51] Int. Cl.[4] ..... A41D 13/00

[52] U.S. Cl. ..... 2/171; 2/174; 2/DIG. 11; 2/209.3

[58] Field of Search ..... 2/171, 181, 181.6, DIG. 11, 2/174, 182.8, 182.3, 182.7, 209.3

[56] References Cited

U.S. PATENT DOCUMENTS

| | | | |
|---|---|---|---|
| 1,750,937 | 3/1930 | Morgan | 2/174 X |
| 1,806,155 | 5/1931 | Farrelly | 2/174 X |
| 2,051,714 | 8/1936 | Huntington | 2/209.3 X |
| 2,320,782 | 6/1943 | Larsen | 2/171 |
| 4,368,545 | 1/1983 | Seidman | 2/174 |
| 4,481,680 | 11/1984 | Mason et al. | 2/181 X |
| 4,521,922 | 6/1985 | Mitchell et al. | 2/DIG. 11 X |

*Primary Examiner*—Peter Nerbun

*Attorney, Agent, or Firm*—Walter J. Monacelli

[57] ABSTRACT

The device described herein comprises a sweatband adapted to collect sweat from the forehead of a runner or other exerciser into a trough and to direct the collected sweat to run out of the collecting trough through draining means positioned so as to let the collected sweat run out at the side of the wearer's head, preferably near his ears. The sweatband preferably has a lip extending upward and inward from the outer side of the trough, or that side not adjacent to the wearer's forehead, whereby any sloshing or overflow of the collected sweat that might be caused by the motion or jarring of the wearer's body will be avoided. In another preferred modification the side of the sweatband which is adapted to be positioned against the wearer's forehead is advantageously made of a wise strip of material to give more firm positioning against the forehead. Since this will cover a substantial area of the forehead, it is preferably to have substantial openings cut into this strip or have the strip molded with these open areas so that sweat from behind the open areas of the band will be allowed to run down into the collecting groove. In still another preferred modification the forehead may be used to form one side of a trough by having a lower portion of the band pressed tightly against the forehead and an upper portion of the band tilted away from the forehead.

5 Claims, 21 Drawing Figures

SWEAT COLLECTING HEADBAND

BACKGROUND OF THE INVENTION

1. Field of the Invention

This invention relates to a specially designed sweatband adapted to collect sweat running down a runner's forehead and provided with a means for preventing splashing and overflowing. More specifically, this sweatband provides a trough for collecting the sweat and a lip on the trough to prevent sloshing or overflow over the edge of the trough.

2. State of the Prior Art

Vigorous exercise is known to produce sweat or perspiration from various parts of the body. When the exercise, such as running, is prolonged, a considerable amount of sweat is produced. If this sweat is allowed to run down unimpeded, it will run down into the eyes or fog eyeglasses. To avoid this sweat bands of terry cloth or other absorbent material have been used for various purposes such as to exert pressure on the head to relieve headaches (U.S. Pat. Nos. 2,320,782 and 3,159,160), and to keep the head cool (U.S. Pat. No. 3,029,438). Headbands have also been used to keep shampoo and other hair treating solutions from running into the eyes such as described in U.S. Pat. Nos. 2,032,898, 3,319,262, 4,368,545 and 4,481,680.

However none of these patents describe the distinctive features described hereinafter for the present invention.

SUMMARY OF THE INVENTION

In accordance with the present invention, a sweatband or headband has been designed which is capable of collecting sweat from a wearer's forehead into a trough or groove. The headband advantageously has one or more such grooves or troughs facing upward and preferably toward the head so that as the sweat is stopped from running down the forehead by the snug fit of the headband against the forehead, the sweat will spill over into and collect in the groove or trough. In the sweatband of this invention the forward side of the grooved portion of the headband is extended upward and then turned inward to form a lip over the groove. When the wearer is running, the jarring of the body as the feet repeatedly hit the ground jostles the sweat collecting in the groove and may cause sloshing and running of the collected sweat over the forward edge of the groove. With this lip as described, forward motion of the collected sweat will be turned back into the groove and thereby avoid the collected sweat from running over the forward edge of the groove.

In a preferred modification the side of the headband which is adapted to be positioned against the wearer's forehead is advantageously made of a wide strip of material to give more firm positioning against the forehead. Since this will cover a substantial area of the forehead, it is preferable to have substantial openings cut into this strip or have the strip molded with these open areas so that sweat from behind the open areas of the band will be allowed to run down into the collecting groove.

In another preferred modification the forehead may be used to form one side of a trough by having a lower portion of the band pressed tightly against the forehead and an upper portion of the band tilted away from the forehead. While the trough or groove is shown in a number of cases as having a curved cross-section, the cross-section of the groove or trough in this as well as in other cases may be a sharp angular trough.

It is contemplated also that the headband may comprise a tube instead of a groove with slots positioned in the tube to allow collected sweat to pass into the interior of the tube. Instead of slots such a tube may have openings of various sizes, from large openings to capillary openings for admission of the sweat to the interior of the tube.

The novel design of this invention may be illustrated by reference to the accompanying drawings in which:

FIG. 1 is a cross-sectional view of a headband of preferred construction having a lip facing inward from the outer edge of the groove to prevent spilling.

FIGS. 2 and 3 are cross-sectional views of headbands of preferred construction having a wide band with substantial open areas and adapted for contact with the wearer's forehead taken at positions 2—2 and 3—3 respectively of the headband of FIG. 7.

DETAILED DESCRIPTION

Figure 1:
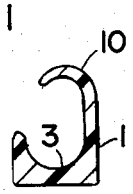

In these Figures, headband 1 has a groove, gutter or trough 3 which faces upward and is adapted to collect sweat running down the forehead. Groove or trough 3 has an opening through which the sweat may be drained from the trough 3. Band 7 may be tightened by buckle 8 to give the headband 1 a tight fit against the forehead.

In addition to the single trough shown in the drawings it is contemplated that the headbands may have two, three or more troughs.

While the foregoing description is directed to headbands collecting sweat from the forehead, it is also intended that the headband may be modified to collect sweat from the back of the head instead of or in addition to collecting from the forehead as shown. In such case the headband portion collecting sweat from the back of the head should slant at least slightly downward to promote flow of the sweat toward openings at the side of the head. In such case elastic portion 7 may be relatively short or may be positioned in the portion in contact with the forehead. The collected sweat is allowed to run off through one or more openings in the lower part of trough 3 positioned so as to be preferably at the side of the head of the wearer, or even farther toward the back of the head.

In place of draining means openings in the groove, the groove may be open at the ends where a strap, such as an elastic band, to hold the headband on the head, is connected to the grooved headband in such a manner that collected sweat may run below the connection to the strap.

Figure 8:
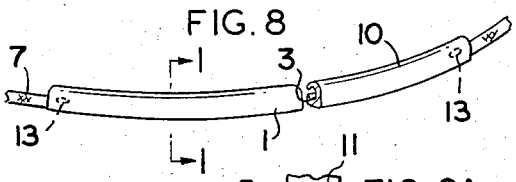
FIG. 8 is a perspective view of another preferred headband modification having the lip portion.

FIG. 1 shows a cross-section of the headband configuration of FIG. 8 taken at line 1—1 which has a lip 10 extending upwardly and inwardly over the groove designed to prevent sloshing or overflowing of the collected sweat as the runner's body is jarred while running.

Figure 2:
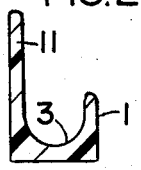
Figure 3:
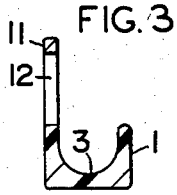
Figure 6:
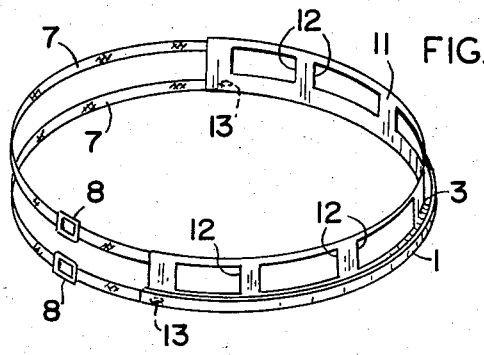
FIG. 6 is a perspective view of preferred headband modification having a wide band having substantial openings therein.
Figure 7:
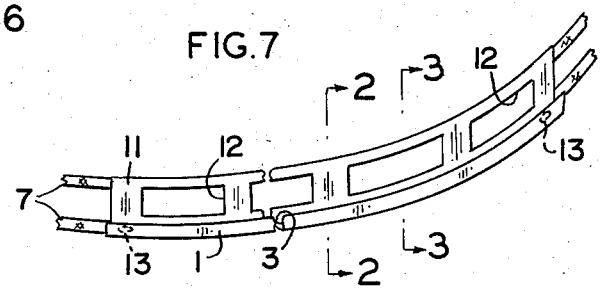
FIG. 7 is a more frontal view of the headband of FIG. 6.

FIGS. 2 and 3 show cross-sections of a preferred headband as shown in FIGS. 6 and 7 with a wide band 11 having substantial openings 12 therein to allow sweat from the forehead to come through and into groove 3. These cross-sections are taken at lines 2—2 and 3—3 respectively of FIG. 7.

Figure 4:
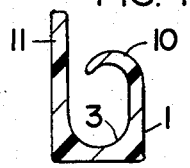
FIGS. 4 and 5 are cross-sectional views of headbands of preferred construction having both the lip to prevent overflow and the wide bands with openings.
Figure 5:
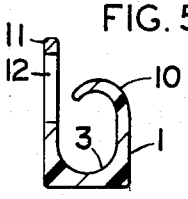

FIGS. 4 and 5 show cross-sections of a preferred headband having both the wide band 11 with openings 12 and also the lip 10 to prevent overflow.

FIG. 6 is a perspective view of a preferred modification of headband having a wide band 11 with substantial openings 12. Drain openings 13 are in the bottom of the grooves near the positions of connection to holding strap 7.

FIG. 7 is a more frontal view of the headband shown in FIG. 6 with lines 2—2 and 3—3 indicating the positions at which the cross-sections of FIGS. 2 and 3 are taken.

FIG. 8 is a perspective view of another preferred modification which has lip 10 to prevent overflow. The cross-section shown in FIG. 1 is taken at lines 1—1.

Figure 9:
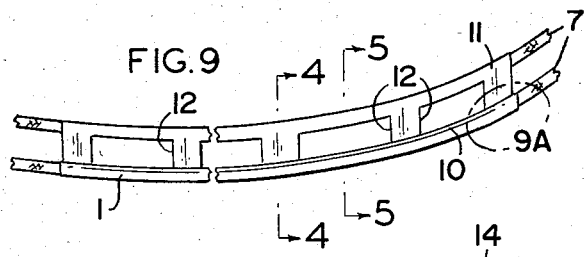
FIG. 9 is a perspective view of another preferred headband modification having both the lip portion and the wide band.

FIG. 9 is a perspective view of another preferred modification which has both the lip 10 and the wide band 11 with substantial openings 12. The cross-sectional views shown in FIGS. 4 and 5 are taken at lines 4—4 and 5—5 respectively.

Figure 9A:
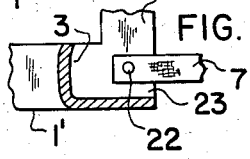

FIG. 9A is a partial cross-sectional view of the lower extreme right end of the modification of FIG. 9 showing removal of part of forward strip 1' of headband 1 so as to show the fastening of holding elastic band 7 to wide band 11 by means of fastener 22. The sweat collecting groove 3 is formed between the wide band 11 and forward strip 1'. Open space 23 beneath band 7 allows collected sweat in groove 3 to flow out through space 23.

Figure 10:
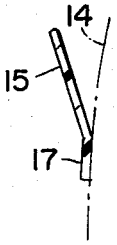
FIG. 10 is a cross-sectional view of another preferred modification in which the collecting trough is formed by using the wearer's forehead as one side of the trough.
Figure 11:
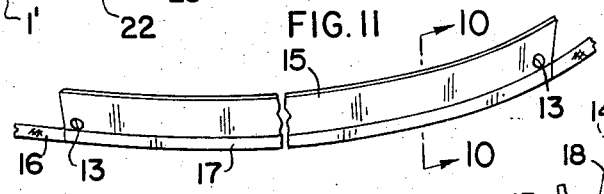
FIG. 11 is a front elevational view of the headband shown in cross-section in FIG. 10.

FIG. 10 is a cross-sectional view of the sweatband having the configuration shown in FIG. 11 taken at line 10—10. Band 17 is held tightly against the wearer's forehead 14 with tilted strip 15 held away at an angle from the forehead so that a trough is formed between strip 15 and forehead 14. Strip 15 may be held in position by having a rigid crimp between strips 17 and 15 or a holding means (not shown) may be used which will not interfere with the flow of sweat in the formed gutter.

As shown in FIG. 11 the strip 17 is held tight enough against forehead 14 to prevent leakage of the sweat between the strip and the forehead by means of adjustable elastic 16 which goes around the back of the wearer's head. Openings 13 are located in strip 15 low enough and close to strip 17 to allow drainage of collected sweat from the gutter. These openings are positioned so that they will be located at the sides of the wearer's head, preferably near the ears.

Figure 12:
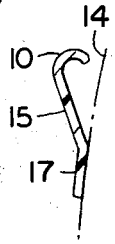
FIG. 12 is a cross-sectional view similar to that shown in FIG. 10 except that a lip has been added to prevent overflow.
Figure 13:
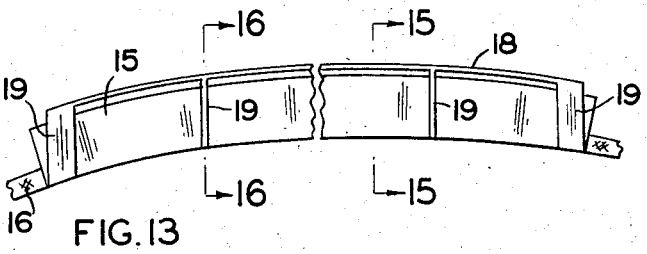
FIG. 13 is a rear elevational view of a trough forming headband having supporting ribs which will be pressed against the wearer's forehead.
Figure 17:
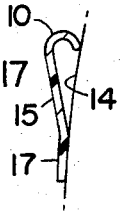
FIG. 17 is a cross-sectional view of a trough-forming headband in which the lip portion extends far enough to reach the wearer's forehead or the opposite side of the trough in which case openings in the lip allow the sweat to run into the trough.
Figure 18:
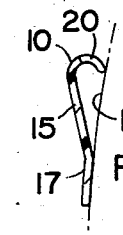
FIG. 18 is another cross-sectional similar to that in FIG. 16 except that the cross-section is taken through one of the openings which allow the sweat to run into the trough.
Figure 14:
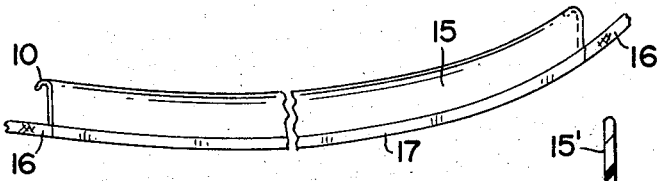
FIG. 14 is a front elevational view of the trough-forming headband shown in cross-section in FIG. 12.

FIG. 12 shows a cross-sectional view of a modification of FIG. 13, as shown in the frontal elevational view of FIG. 14, which has a lip 10 positioned at the upper edge of strip 15 which will prevent overflow or sloshing of collected sweat from the trough and into the wearer's face or eyes. In case strip is pulled against the forehead as shown in the cross-sectional view of FIG. 17, openings 20 are provided as shown in FIG. 18 along the length of the lip so as to allow sweat from the forehead above the lip to flow into the trough.

FIG. 13 shows another sweatband configuration in which a collecting trough is formed between the wearer's forehead (not shown) and tilted strip 15 is held by a structure comprising ribs 18 and 19 which is held against the forehead by elastic band 16. Ribs 18 and 19 are of appropriate strength to give rigid support of strip 15. Ribs 18 and 19 are pressed tightly against the forehead to guard against leakage of collected sweat between strip 15 and the forehead. Openings (not shown) are provided in a lower region of strip 15 to allow drainage of the sweat from the trough, preferably these openings being positioned near the ears of the wearer.

Figure 15:
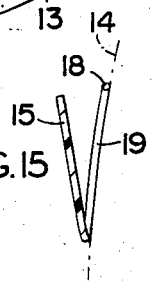
FIG. 15 is a cross-sectional view of the trough-forming headband of FIG. 13 taken at line 15—15.
Figure 16:
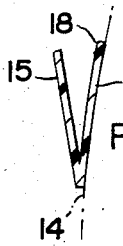
FIG. 16 is a cross-sectional view of the trough-forming headband of FIG. 13 taken at line 16—16.

FIGS. 15 and 16 show cross-sectional views of the headband structure of FIG. 13 taken at lines 15—15 and 16—16 respectively.

Figure 19:
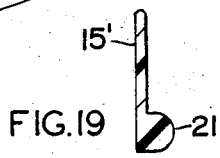
FIG. 19 is a cross-sectional view of another trough-forming headband which has a bulbular or curved lower portion for pressing against the wearer's forehead.

FIG. 19 shows a cross-sectional view of a headband structure in which a bulbular rib or section 21 is pressed against the wearer's forehead with strip 15' extending upward and spaced from the forehead so as to form a collecting trough in conjunction with the forehead.

Figure 20:
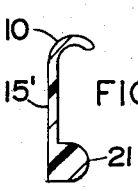
FIG. 20 is a cross-sectional view of another trough-forming headband with a bulbular lower portion and having a lip at the top of the trough forming side of the headband.

FIG. 20 is a cross-sectional view showing modification of the headband structure of FIG. 19 in which 11p 10 is provided to prevent overflow and as well as to guard against strip 15' being pressed against the forehead.

Figure 21:
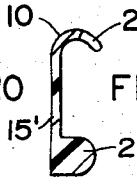
FIG. 21 is a cross-sectional view similar to that of FIG. 20 except that the cross-section is taken at an opening in the lip designed to allow sweat to pass through into the trough.

FIG. 21 is another cross-sectional view of the headband structure of FIG. 19 in which openings 20 have been provided to insure that sweat can flow down into the trough.

As referred to above there may be openings at the bottom of the trough positioned at the side of the head of the wearer which are designed to serve as the "draining means". The gutter or trough may be fixed in shape either by molding, thermoforming or cutting into that shape.

When reference is made to the width of the strip comprising the portion of the headband to be in contact with the wearer's head, this means the vertical distance from the top of the trough to the upper edge of the strip when the headband is positioned horizontally around the head of the wearer. This width is advantageously in the range of 0.25 to 2.5 inches. The overall area of the openings of substantial size advantageously occupy between 25% to 95% of the overall area of this strip.

The headbands may be of various materials suitable for this purpose such as plastics, rubber, leather, etc., preferably of a flexible non-absorbent nature. The cross-section of the headband portion bearing the gutter or trough may be circular, triangular, rectangular, etc.

While certain features of this invention have been described in detail with respect to various embodiments thereof, it will of course be apparent that other modifications can be made within the spirit and scope of this invention and it is not intended to limit the invention to the exact details insofar as they are defined in the following claims.

The invention claimed is:

1. A headband assembly comprising a headband of flexible non-absorbent material adapted to be fitted directly and snugly against the forehead of the wearer, said headband having at least one trough permanently fixed therein extending along a substantial portion of the length of said headband, said trough being disposed in said headband so as to intercept and collect sweat running down the head of the wearer and having draining means located so as to be positioned at the side of the wearer's head to allow the running off of collected sweat from said trough, the side of said trough adapted to being fitted tightly against the wearer's forehead comprising a strip having a width of 0.25–2.5 inches and having open portions therein comprising a total of 25–95% open area, said assembly also comprising a means for holding said headband tightly against the wearer's forehead.

2. The assembly of claim 1 in which said holding means comprises an elastic band fastened to said headband.

3. The assembly of claim 1 in which said holding means comprises an elastic band connected to said headband, and said draining means comprises an open space below the said connection to said elastic band.

4. The assembly of claim 1 in which said trough has a lip extending inwardly at the upper and outer edge thereof whereby collected sweat in said trough is prevented from spilling over the said outer edge of said trough.

5. The assembly of claim 4 in which said lip has openings at or near the edge of said lip which is not joined to said strip whereby, in the event said lip should reach to the wearer's forehead, sweat from the forehead region above said lip will be permitted to flow to said trough through said openings.

* * * * *

UNITED STATES PATENT AND TRADEMARK OFFICE

CERTIFICATE OF CORRECTION

PATENT NO. : 4,638,512

DATED : Jan. 27, 1987

INVENTOR(S) : Alfred R. Frankel

It is certified that error appears in the above-identified patent and that said Letters Patent is hereby corrected as shown below:

In the abstract, line 12 from the end, correct "wise" to read "wide"; line 9 from the end, correct "preferably" to read "preferable".

Signed and Sealed this

Fourteenth Day of April, 1987

*Attest:*

DONALD J. QUIGG

*Attesting Officer*

*Commissioner of Patents and Trademarks*